US008259060B2

(12) United States Patent
Li et al.

(10) Patent No.: US 8,259,060 B2
(45) Date of Patent: Sep. 4, 2012

(54) DRIVE CURRENT OF LIGHT SOURCE BY COLOR SEQUENTIAL METHOD

(75) Inventors: Ling Li, Hualien (TW); Wen-Chih Tai, Jhongli (TW); Chia-Lin Liu, Daya Township, Taichung County (TW); Chi-Neng Mo, Jhongli (TW)

(73) Assignee: Chunghwa Picture Tubes, Ltd., Bade, Taoyuan County (TW)

( * ) Notice: Subject to any disclaimer, the term of this patent is extended or adjusted under 35 U.S.C. 154(b) by 543 days.

(21) Appl. No.: 12/432,143

(22) Filed: Apr. 29, 2009

(65) Prior Publication Data

US 2010/0149221 A1 Jun. 17, 2010

(30) Foreign Application Priority Data

Dec. 16, 2008 (TW) ..... 97149050 A

(51) Int. Cl.
*G09G 3/36* (2006.01)

(52) U.S. Cl. ..... 345/102

(58) Field of Classification Search ..... 345/102, 345/82–83, 88

See application file for complete search history.

(56) References Cited

U.S. PATENT DOCUMENTS

| | | | | |
|---|---|---|---|---|
| 5,977,942 | A * | 11/1999 | Walker et al. | 345/97 |
| 6,734,875 | B1 * | 5/2004 | Tokimoto et al. | 345/690 |
| 6,744,443 | B2 | 6/2004 | McKnight et al. | |
| 7,982,706 | B2 * | 7/2011 | Ichikawa et al. | 345/102 |
| 2004/0246275 | A1 * | 12/2004 | Yoshihara et al. | 345/690 |
| 2005/0116922 | A1 * | 6/2005 | Kim | 345/102 |
| 2006/0152468 | A1 * | 7/2006 | Ozaki | 345/102 |
| 2007/0222743 | A1 * | 9/2007 | Hirakata | 345/102 |
| 2008/0158138 | A1 * | 7/2008 | Yamazaki et al. | 345/102 |
| 2008/0158140 | A1 * | 7/2008 | Takatori et al. | 345/102 |
| 2009/0040173 | A1 * | 2/2009 | Ezaki et al. | 345/102 |

* cited by examiner

*Primary Examiner* — Chanh Nguyen
*Assistant Examiner* — Roy Rabindranath
(74) *Attorney, Agent, or Firm* — Muncy, Geissler, Olds & Lowe, PLLC

(57) ABSTRACT

The present invention relates to a drive circuit of light source by color sequential method for generating a full-color image based on sequential switching between red, green and blue illuminations. The drive circuit of light source by color sequential method includes a color-sequential control circuit and a plurality of radiating areas coupled to multiple light units. The color-sequential control circuit is connected to those radiating areas to control the operation thereof by the color sequential method.

4 Claims, 4 Drawing Sheets

DRIVE CURRENT OF LIGHT SOURCE BY COLOR SEQUENTIAL METHOD

FIELD OF THE INVENTION

The present invention is generally related to light emitting technologies for display. More particularly, the present invention is related to a drive circuit of light source by color sequential method.

DESCRIPTION OF THE PRIOR ART

Credited to the development of technology, the video products such as digitalized video or image displaying devices have become the general products for consumers. Because of the well maturity and the low prices provided by LCD panel industries, the video or image displaying devices are almost carried out by LCD related devices. So the LCD components are getting more and more important. Users can acquire the needed information from the LCD display devices. Typically, the LCD includes the opposed substrate comprising the common electrode and the color filters, the thin film transistor array (TFT) substrate comprising TFT array and the plurality of electrodes, and the liquid crystal layers set between them. Applying the electric voltage to the pixel electrodes and the common electrodes will generate an electric field, and the variability of the electric field will change the directivity of the liquid crystal molecules within the liquid crystal layer and the light transmittance through the liquid crystal layer. By adjusting the voltage difference between the pixel electrodes and common electrodes, the wanted images may be displayed on the LCD display.

The conventional opposed substrate comprising a substrate, a plurality of color filter patterns, black matrices, and transparent electrode layers. The color filter patterns are set on the substrate and are corresponding to the pixel area of the substrate of the TFT array. Each of the color filter patterns are separated by the black matrices. And the transparent electrode layers are covered on the color filter patterns and black matrices.

The U.S. Pat. No. 6,744,443 disclosed a look up table method applying for display, and the framework of the display includes look up table (LUT), digital to analog converter, controller, and timer.

By loading the corresponding LUT data, the color balance adjustment is automatically achieved to precisely reconstruct the white color effect in all conditions and to provide the function of white balance. By this way, the display is easier to drive, such as the general way of driving by additional driving ICs. However, it still needs adding color filters to generate full color images, so the production cost is still high.

The conventional devices need color filters to generate color images, and consequently, the cost is getting higher.

SUMMARY OF THE INVENTION

Based on the above illustration, the present invention is intent to provide a drive circuit of light source by color sequential method without need of using color filters.

The present invention discloses a drive circuit of light source by color sequential method, including a plurality of radiating areas; a plurality of light units coupled with the plurality of radiating areas to provide the light for the plurality of radiating areas; and a color sequential control circuit electrically connected to the plurality of radiating areas and controlled display of the plurality of radiating areas.

The present invention also discloses a drive circuit of light source by color sequential method, including a plurality of radiating areas; a plurality of light units coupled with the plurality of radiating areas to provide the light for the plurality of radiating areas; a color sequential control circuit electrically connected to the plurality of radiating areas; and a charge recycle circuit connected to the plurality of radiating units. When the plurality of light units shift from green or blue to red light units, the charge recycle circuit will save the voltage difference of the second voltage subtracting the first voltage and output the first voltage level.

Wherein each of the radiating area includes a dual loop pulse width modulation (PWM) control circuit connected to the charge recycle circuit; a boost circuit connected to the positive electrodes of the plurality light units and the dual loop PWM control circuit to provide a first voltage or a second voltage to the plurality of light units; and a level sift circuit to shift the voltage level received by the level shift circuit to another voltage level for providing to the boost circuit.

The first voltage drives the red light units, while the second voltage drives the green or blue light units; wherein the first voltage is lower than the second voltage.

When the plurality of light units shift from green or blue to red light units, the charge recycle circuit will save the voltage difference of the second voltage subtracting the first voltage and output the first voltage level.

Said color sequential control circuit includes a counter; a shift register connected to the counter; a control signal pattern unit connected to the counter and the shift register to provide control signals to a current balancing circuit; and a voltage switching unit connected to the counter to switch the voltage.

The light source display which is displayed by color sequential method of the present invention utilizes the color sequential method to control the retention time of the red, green, and/or blue color displayed on the display, and the full-color images are achieved by color mixing of visual persistence effect. The production cost of the display is reduced by forsaking using color filters.

The color sequential method of the present invention is implemented by hardware control solution of integrating the digital signals into a single IC. The display by the color sequential method is accomplished by the architecture of simple circuits, and the control signal patterns can be modified directly.

Further, the charge recycle circuit of the light source display which is displayed by the color sequential method of the present invention can effectively reduce the charging time of the boost circuit and hasten the voltage switching rate when switching the light source of red, green or blue light units.

BRIEF DESCRIPTION OF THE DRAWINGS

The elements, features, and the advantages of the present invention can be more understood by referring to the following description and accompanying drawings that are used to illustrate embodiments, wherein.

DESCRIPTION OF THE PREFERRED EMBODIMENT

The present invention is disclosed with the preferred embodiments and the figures of the accompanying drawings as follows. It is appreciated that the preferred embodiments are illustrated by way of example, and not by way of limitation. In addition, the present invention can be widely applied to other embodiments besides the preferred embodiments in the specification. The present invention is not limited to any embodiments, and the scope of the present invention should be defined by the claims.

Reference in the specification to "one embodiment" or "an embodiment" means that a particular feature, structure, or characteristic described in connection with the embodiments is included in at least one preferred embodiment of the present invention, and therefore the various appearances of "in one embodiment" or "in an embodiment" are not necessarily all referring to the same embodiments. Further, the various features, structures, or characteristics are able to be grouped together in one or more preferred embodiments.

The present invention discloses a drive circuit of light source by color sequential method. The present invention uses the color sequential method to control the retention time of the red, green, and/or blue color displayed on the display, and the full-color images are achieved by color mixing of visual persistence effect on the retina. The production cost of the display is reduced by forsaking using color filters. Further, the charge recycle circuit of the present invention can effectively reduce the charging time of the boost circuit and hasten the voltage switching rate when switching the light source of red, green or blue light units.

Figure 1:
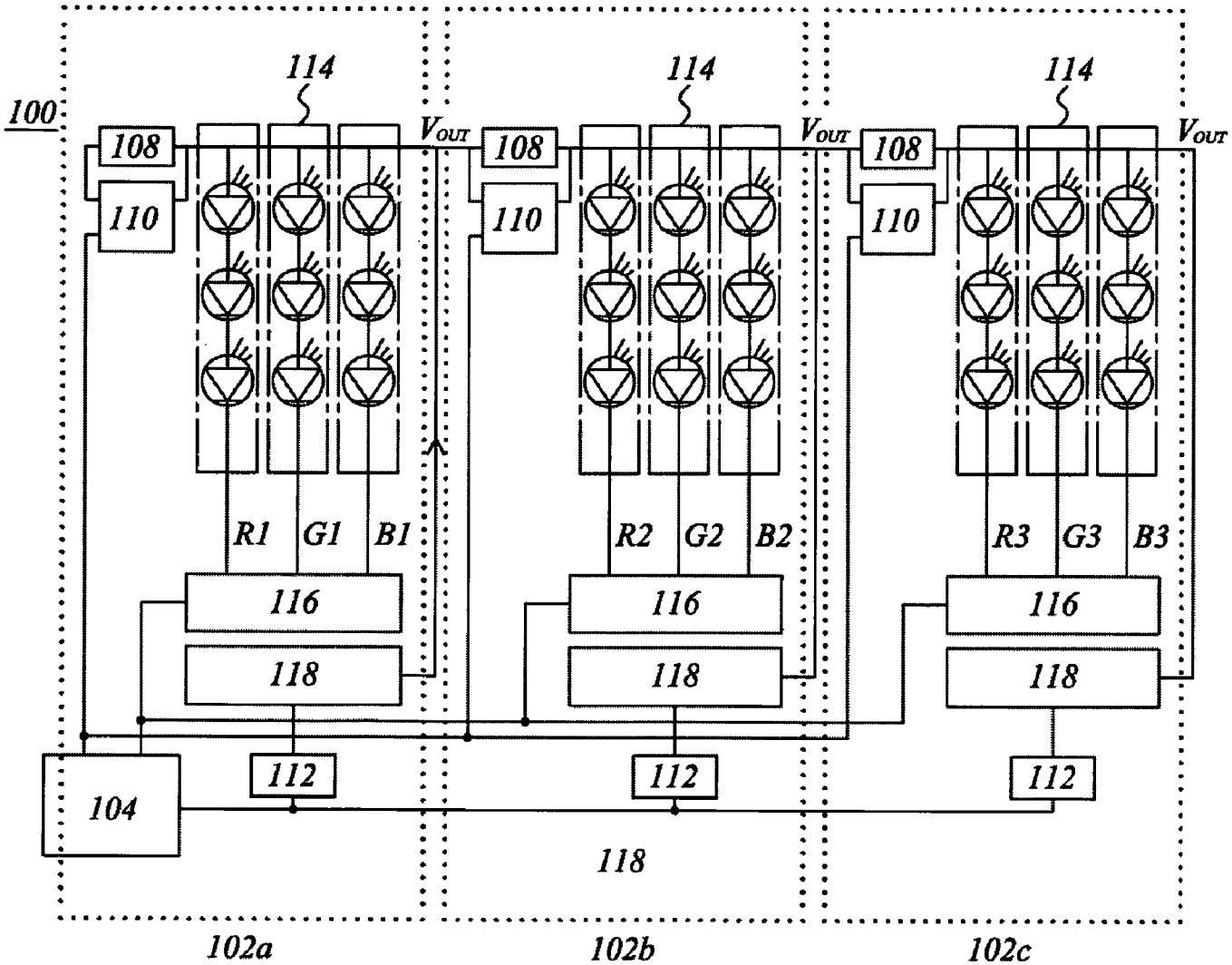
FIG. 1 is a schematic diagram of the drive circuit of light source by the color sequential method according to the preferred embodiment of the present invention.

FIG. 1 is an illustration of the drive circuit of light source 100 by color sequential method of the embodiment of the present invention. Light source 100 comprises a plurality of radiating areas such as 102*a*, 102*b*, and 102*c*. Color sequential control circuit 104 is coupled with each of the radiating area 102*a*, 102*b*, or 102*c*, so that the color sequential control circuit 104 can employ the color sequential method to determine the operational timing and control the color of the plurality of radiating areas 102*a*, 102*b*, and 102*c*.

Each of the radiating area 102*a*, 102*b*, and 102*c* has a boost circuit 108, dual loop PWM control circuit 110, level shift circuit 112, light unit 114, current balancing circuit 116, and charge recycle circuit 118.

In the embodiment, the radiating area 102*a* is illustrated as an exemplary embodiment. However, all of the radiating areas within the light source 100 are with the same assignment, so the similar parts of the radiating areas 102*b* and 102*c* are not given unnecessary details. Refer to the radiating area 102*a*, wherein the light unit 114 comprises three light units as red $R_1$, green $G_1$, and blue $B_1$, and the light source 100 is formed. In the preferred embodiment, wherein the light units red $R_1$, green $G_1$, or blue $B_1$ can be implemented as light emitting diode (LED) of red, green, or blue. Light unit 114 is formed by the serial connection of the paths of the light emitting diodes of red $R_1$, green $G_1$, and blue $B_1$.

Boost circuit 108 is connected to dual loop PWM control circuit 110, light unit 114, and charge recycle circuit 118. Boost circuit 108 boosts the input voltage and provides the boosted voltage to the light unit 114. Boost circuit 108 can be a general boost circuit comprising inductors, power transistors, diodes, and the buffers for driving power transistors.

Boost circuit 108 provides light unit 114 the first voltage $V_1$ or the second voltage $V_2$ which depends on the control signals of control circuit 104. For example, the first voltage $V_1$ is the operating voltage of LED of red, and the second voltage $V_2$ is the operating voltage of LED of blue or green, wherein the first voltage $V_1$ is lower than the second voltage $V_2$.

Control circuit 104 transfers the voltage signals to charge recycle circuit 118 via level shift circuit 112. Level shift circuit 112 is implemented to shift the encoded digital voltage signals provided by control circuit 104 from about 5V to about 12V, and then the shifted ones are provided to charge recycle circuit 118.

Dual loop PWM control circuit 110 provides the input voltage to boost circuit 108. By controlling the input voltage for boost circuit 108, the on-state time period of the power transistor within the boost circuit 108 can be adjusted, and the charging and discharging time period of the inductor within the boost circuit 108 can be determined.

Dual loop PWM control circuit 110 has over-current mode and normal mode. In the over-current mode, to prevent the current of inductor of boost circuit 108 exceeding and the inductor saturating, dual loop PWM control circuit 110 generates limited current signals to turn-off the power transistor. In the normal mode, dual loop PWM control circuit 110 acquires the feedback signals to compare with the feed-forward signals for fine-tuning the inductor current to keep constant, and thus generating precise pulse width modulation signals.

Figure 2:
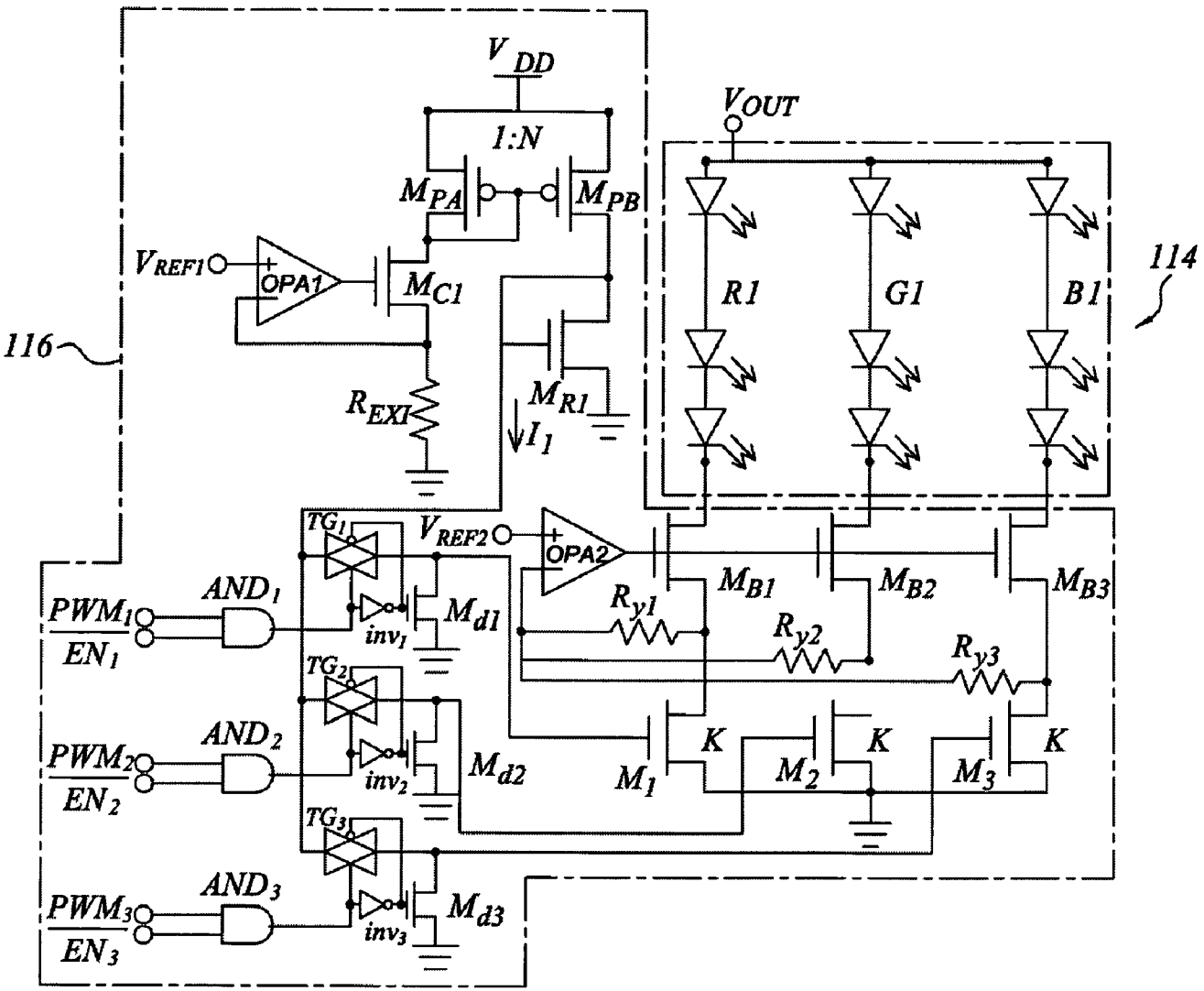
FIG. 2 is a circuit pattern diagram of the current balancing circuit according to the preferred embodiment of the present invention.

A current balancing circuit 116 is connected to control circuit 104 and the negative electrodes of light units red $R_1$, green $G_1$, and blue $B_1$. The current balancing circuit 116 is utilized to keep the balance of current of all the light units red $R_1$, green $G_1$, and blue $B_1$ and the balance of luminance. Please refer to the circuit pattern diagram of the current balancing circuit 116 in the FIG. 2 as an embodiment.

The current balancing circuit 116 is connected to light unit 114. Light unit 114 is formed by the serial connection of paths of LED of red R1, green G1, and blue B1. The current balancing circuit 116 comprises two operational amplifiers (OPA) $OPA_1$ and $OPA_2$. $OPA_1$ is utilized to provide current mirror function to stabilize current. Current $I_1$ can be controlled via adjusting voltage $V_{RF1}$ and resistance $R_{ext}$. $OPA_2$ is connected to resistances $R_{y1}$, $R_{y2}$, and $R_{y3}$ and Metal-Oxide-Semiconductor (MOS) switches $M_1$, $M_2$, and $M_3$ for the purpose of eliminating the channel length modulation effect generated by current mirrors.

The inputs PWM and EN of control gates $AND_1$, $AND_2$, and $AND_3$ receive the control signals to control the operation of the serial connection of paths of LEDs. The input EN, a signal of "enable", controls the connection and disconnection of the serial connection of paths of LEDs; the input PWM controls the connection time of the paths of the LEDs.

When input $EN_1$ receives the input signal "1" and $PWM_1$ is "on" for receiving the control signals, the transmission gate $TG_1$ is triggered on "on-state" and the current $I_1$ is provided to the gate of switch $M_1$ to turn on the switch $M_1$. The path of LED $R_1$ is then conducted to emit light. The connection time of the paths of LEDs can be adjusted by controlling the input signals to PWM.

Refer to FIG. 1, charge recycle circuit 118 is connected to a level shift circuit 112 and the positive electrodes of light units red $R_1$, green $G_1$, and blue $B_1$. The switching voltage between the first voltage $V_1$ and the second voltage $V_2$ can be stored by charge recycle circuit 118. If the voltage is turned from high to low, the excess of charge will be stored within the capacitor of charge recycle circuit 118; if the voltage is turn from low to high, the excess of charge stored within the capacitor of charge recycle circuit 118 will be released to output end $V_{out}$, and then the charging time of boost circuit 108 is shortened.

When light unit 114 of radiating area 102*a* is shifted from path of LED green $G_1$ or blue $B_1$ to path of LED red $R_1$, charge recycle circuit 118 will store the switching voltage to maintain the level of the first voltage $V_1$. When light unit 114 of radiating area 102*a* is shifted from path of LED red $R_1$ to path of LED green $G_1$ or blue $B_1$, charge recycle circuit 118 will add the stored voltage to output $V_{out}$ to maintain the second voltage $V_2$ for light unit 114.

The control circuit 104 is connected to current balancing circuit 116 of radiating areas 102*a*, 102*b*, and 102*c*, respectively. By controlling the signals transmitted to PWM and EN of current balancing circuit 116, the operation of the paths of LEDs can be controlled by the control circuit 104. The control circuit 104 is connected to the level shift circuit 112 to directly lift the voltage level of the encoded digital voltage signals transmitted by control circuit 104 and input the lifted ones to charge recycle circuit 118.

Figure 3:
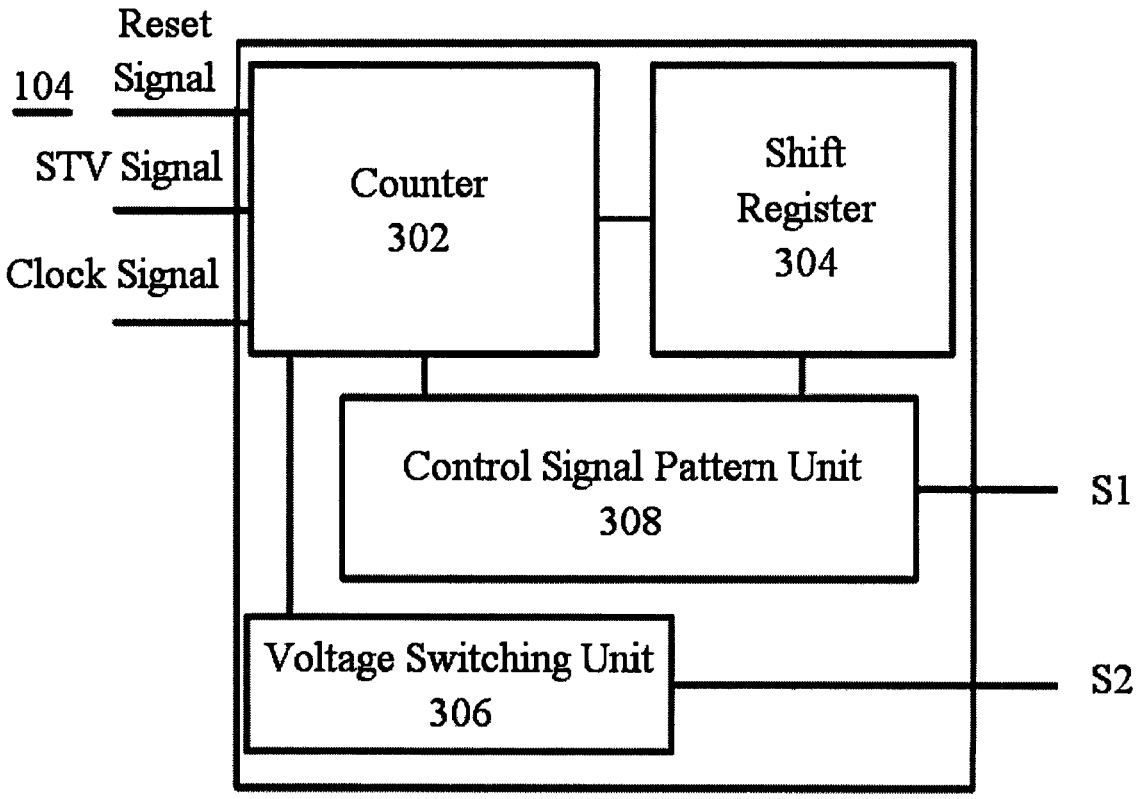
FIG. 3 is a block diagram of the color sequential control circuit according to the preferred embodiment of the present invention.

FIG. 3 is an illustration of the block diagram of the control circuit 104 according to the preferred embodiment of the present invention. The control circuit 104 includes counter 302, shift register 304, voltage switching unit 306, and control signal pattern unit 308.

The input signals of control circuit 104 include reset signal, start pulse vertical (STV) signal, and clock pulse vertical (CPV) signal. The reset signal is utilized to clean the display on display region. The output signals include the first control signal $S_1$ and the second control signal $S_2$. The eighteen outputs of control signal pattern unit 308 provide the first control signal $S_1$ to current balancing circuit 116. The first control signal $S_1$ is provided to PWM and EN of current balancing circuit 116 after encoding by digital-to-analog converter (DAC). The eighteen outputs are equally distributed to current balancing circuit 116 of radiating areas 102*a*, 102*b*, and 102*c* to control the operation of the display region of control light source 100. The definition of the first control signal is illustrated as Table 1.

If the PWM signal is "X" and EN signal is "0" (Low), the light unit is not allowed to work (i.e., the display region shows black frame insertion and scanning processes); if the PWM signal is "On" (i.e., the periodic signal represented of green/blue light units) and EN signal is "1", then it shows the blue or green light units; if the PWM signal is "Off" (i.e., the periodic signal represented of red light units) and EN signal is "1", then it shows the red light unit.

For example, at the first state KBB, the three display regions display black (K), blue, blue, respectively. Then radiating area 102*a* is not working, and the display region shows black (black frame insertion). Radiating area 102*b* has the value of "1" on only its P6 and E6 signals and shows the blue light unit. Radiating area 102*c* has the value of "1" on only its P9 and E9 signals and shows the blue light unit as well.

At the fifth state GKR, radiating areas 102*a-c* display green, black, and red, respectively. Radiating area 102*a* has the value of "1" on only its P2 and E2 signals and shows green; radiating area 102*b* has no actuating signal and shows black; radiating area 102*c* has the value of "0" on its P7 signal and the value of "1" on its E7 signal and shows red. The other states follow the same rule as well and are not given unnecessary details.

Voltage switching unit 306 has three outputs to provide the second control signal $S_2$ to charge recycle circuit 118 and the switching signal for the first voltage $V_1$ and the second voltage $V_2$ as Table 2.

TABLE 2

| Status | $R_1G_1B_1$ | $R_2G_2B_2$ | $R_3G_3B_3$ |
|---|---|---|---|
| (1) KBB | $V_1$ | $V_2$ | $V_2$ |
| (2) RKB | $V_1$ | $V_1$ | $V_1$ |
| (3) RRK | $V_1$ | $V_1$ | $V_2$ |
| (4) KRR | $V_1$ | $V_1$ | $V_1$ |
| (5) | $V_2$ | $V_1$ | $V_1$ |

TABLE 1

| | Display Region 102a | | | | | | Display Region 102b | | | | | | Display Region 102c | | | | | |
|---|---|---|---|---|---|---|---|---|---|---|---|---|---|---|---|---|---|---|
| | P1 | E1 | P2 | E2 | P3 | E3 | P4 | E4 | P5 | E5 | P6 | E6 | P7 | E7 | P8 | E8 | P9 | E9 |
| (1)KBB | X | 0 | X | 0 | X | 0 | X | 0 | X | 0 | 1 | 1 | X | 0 | X | 0 | 1 | 1 |
| (2)RKB | 0 | 1 | X | 0 | X | 0 | X | 0 | X | 0 | X | 0 | X | 0 | X | 0 | 1 | 1 |
| (3)RRK | 0 | 1 | X | 0 | X | 0 | 0 | 1 | X | 0 | X | 0 | X | 0 | X | 0 | X | 0 |
| (4)KRR | X | 0 | X | 0 | X | 0 | 0 | 1 | X | 0 | X | 0 | 0 | 1 | X | 0 | X | 0 |
| (5)GKR | X | 0 | 1 | 1 | X | 0 | X | 0 | X | 0 | X | 0 | 0 | 1 | X | 0 | X | 0 |
| (6)GGK | X | 0 | 1 | 1 | X | 0 | X | 0 | 1 | 1 | X | 0 | X | 0 | X | 0 | X | 0 |
| (7)KGG | X | 0 | X | 0 | X | 0 | X | 0 | 1 | 1 | X | 0 | X | 0 | 1 | 1 | X | 0 |
| (8)BKG | X | 0 | X | 0 | 1 | 1 | X | 0 | X | 0 | X | 0 | X | 0 | 1 | 1 | X | 0 |
| (9)BBK | X | 0 | X | 0 | 1 | 1 | X | 0 | X | 0 | 1 | 1 | X | 0 | X | 0 | X | 0 |

P1-P9 represent the PWM signals inputted to the circuit balancing circuit 116 within the radiating areas 102a-102c. E1-E9 represent the EN signals inputted to the circuit balancing circuit 116. P1-P3 and E1-E3 correspond to radiating areas 102a; P4-P6 and E4-E6 correspond to radiating areas 102b; P7-P9 and E7-E9 correspond to radiating area 102c.

TABLE 2-continued

| Status | $R_1G_1B_1$ | $R_2G_2B_2$ | $R_3G_3B_3$ |
|---|---|---|---|
| GKR (6) | $V_2$ | $V_2$ | $V_1$ |
| GGK (7) | $V_1$ | $V_2$ | $V_2$ |
| KGG (8) | $V_2$ | $V_1$ | $V_2$ |
| BKG (9) | $V_2$ | $V_2$ | $V_1$ |
| BBK | | | |

The first voltage $V_1$ and second voltage $V_2$ are defined for telling from the three different LEDs as red, green, and blue by two voltages. For example, the operational voltage of red LED is at first voltage $V_1$ and the operational voltage of green or blue LED is at second voltage $V_2$. When display region shows black frame insertion, the light source is interrupted, and either first voltage $V_1$ or second voltage $V_2$ is acceptable.

Figure 4:
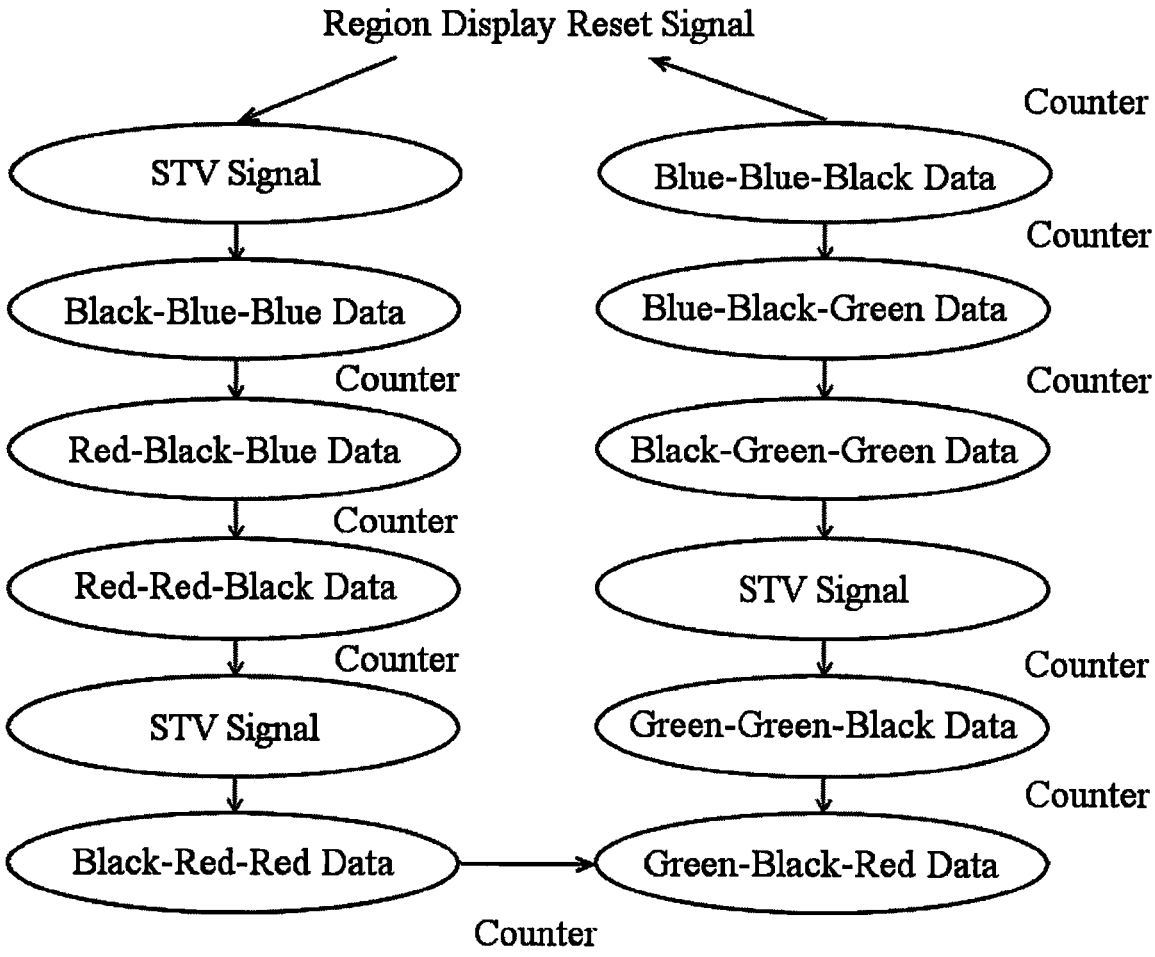
FIG. 4 is a schematic diagram of the operation of the drive circuit of light source by the color sequential method according to the preferred embodiment of the present invention.

FIG. 4 shows the flow chart of the operational processes of light source 100. First, the reset signal is transferred to control circuit 104 to clean the display on display region. Then, the STV signal is transferred to control circuit 104 to trigger signal pattern unit 308 to transfer the first state KBB data. The voltage switching unit 306 transfers the control signal corresponding to the voltage of the first state to charge recycle circuit 118. The clock signals are summed up by counter 302. The total summed up counts of the each display region is "256", if the resolution of the display is "768×1400". When the summed up counts of counter 302 reach "256", control signal pattern unit 308 will send the second state RKB data, and voltage switching unit 306 will renew the operational voltage of the charge recycle circuit. When the third state RRK is taken, all the three display regions have been scanned in turns by processes of black frame insertion. The start signal is transferred at this time for transferring the fourth state KRR data. The following steps follow the same rule. After the nine states have been taken turns, the display is cleaned by a reset signal and recycled again.

The present invention utilizes the color sequential method to control the time of the red, green, and blue color staying on the display and utilizes the visual persistence effect to achieve full-color effect by color mixing of visual persistence. There are several advantages of the present invention: (1) without using of color filters, the production costs of the displays are reduced; (2) without using of color filters, the displays of the present invention have a greater light transmittance; (3) with dynamically adjustable voltage of the present invention, the power consumption of the present invention is reduced; comparing to conventional display with color filter comprising three sub-pixels, the display of the present invention has a higher resolution then the conventional display; (4) with the utilizing of red, green, and blue LEDS as the backlights, the display of the present invention has a better color saturation of image.

Further, the present invention includes the charge recycle circuit to provide switching voltage when switching the light sources of red, green or blue, effectively shorten the charging time of boost circuit, and hasten the voltage switching rate.

The foregoing description of the preferred embodiments of the present invention is for purposes of explanation but not limit. It is intended that the following claims and their equivalents define the scope of the present invention. The embodiments enable others skilled in the art to best utilize the present invention and various embodiments with various modifications and variations, and they should be still within the scope of the following claims.

What is claimed is:

1. A drive circuit of light source by color sequential method, comprising:

a plurality of radiating areas;

a plurality of light units, including a red light unit, a green light unit and a blue light unit, in each of said plurality of radiating areas, to provide required light to said plurality of radiating areas;

a color sequential control circuit electrically connected to a dual loop pulse width modulation control circuit and a level shift circuit in each of said plurality of radiating areas, to control the display of the plurality of light units in each of said plurality of radiating areas by color sequential method; and a charge recycle circuit connected to the plurality of light units and the level shift circuit in each of said plurality of radiating areas, to store voltage difference of a second voltage of the blue light unit or the green light unit subtracting a first voltage of the red light unit and output a first voltage level when said plurality of light units turn from the green unit or blue light unit to the red light unit, wherein the dual loop pulse width modulation control circuit is connected to positive electrodes of said plurality of light units, and each of said radiating areas includes:

a boost circuit connected to said positive electrodes of said plurality of light units, to provide said first voltage or said second voltage to said plurality of light units, wherein the level shift circuit is used to shift inputted voltage level of said level shift circuit to another voltage level to provide to said boost circuit; and a current balancing circuit connected to negative electrodes of said plurality of light units and said color sequential control circuit to provide current balancing of said light units of red, green, or blue and reduce deviation of current, and wherein said color sequential control circuit comprises:

a counter;

a shift register connected to said counter;

a control signal pattern unit connected the said counter and said shift register, to provide control signal to said current balancing circuit; and a voltage switching unit connected to said counter, to switch voltage.

2. The drive circuit of light source by color sequential method of claim 1, wherein said charge recycle circuit will release voltages and provide said voltages to said plurality of light units, to make said plurality of light units maintain a second voltage level when said plurality of light units turn from the red light unit to the green or the blue light unit.

3. The drive circuit of light source by color sequential method of claim 1, wherein said first voltage is lower than said second voltage.

4. The drive circuit of light source by color sequential method of claim 1, wherein said plurality of light units includes a plurality of light emitting diodes.

* * * * *